US007210739B2

(12) United States Patent
Baines

(10) Patent No.: US 7,210,739 B2
(45) Date of Patent: May 1, 2007

(54) SOFA SLIP COVER AND COVERED SOFA

(75) Inventor: David Morris Baines, New Canaan, CT (US)

(73) Assignee: Maytex Mills, Inc., Yonkers, NY (US)

( * ) Notice: Subject to any disclaimer, the term of this patent is extended or adjusted under 35 U.S.C. 154(b) by 52 days.

(21) Appl. No.: 10/962,533

(22) Filed: Oct. 13, 2004

(65) Prior Publication Data

US 2006/0103197 A1 May 18, 2006

(51) Int. Cl.
*A47C 31/00* (2006.01)
*A47C 31/10* (2006.01)

(52) U.S. Cl. ..... 297/225; 297/229; 297/228.1; 297/228

(58) Field of Classification Search ..... 297/228.1, 297/229, 225, 219.1, 228, 228.13, 227
See application file for complete search history.

(56) References Cited

U.S. PATENT DOCUMENTS

| | | | | |
|---|---|---|---|---|
| 1,820,104 | A | 8/1931 | Whaley | |
| 1,996,575 | A | 4/1935 | Fry et al. | 155/182 |
| 2,083,236 | A * | 6/1937 | Levi | 297/229 |
| 2,129,225 | A | 9/1938 | Mednick | 155/182 |
| 2,212,485 | A | 8/1940 | Krasnov | 155/182 |
| 2,367,450 | A | 1/1945 | Trubitz | |
| 2,877,832 | A * | 3/1959 | Reavis | 297/228 X |
| 2,921,625 | A | 1/1960 | Krasnov et al. | |
| 3,195,950 | A * | 7/1965 | Mednick | 297/227 |
| 3,298,047 | A * | 1/1967 | Feinerman | 297/228.1 X |
| 3,371,957 | A | 3/1968 | Cook | 297/219 |
| 5,234,252 | A | 8/1993 | Wallach | 297/229 |
| 5,265,933 | A | 11/1993 | Croshaw | 297/228.1 |
| 5,494,330 | A * | 2/1996 | Fotsch | 297/229 X |
| 5,611,595 | A | 3/1997 | Gatehouse | 297/228.12 |
| 5,664,831 | A | 9/1997 | White et al. | 297/225 |
| 5,676,422 | A * | 10/1997 | White et al. | 297/225 |
| 5,733,002 | A | 3/1998 | Riley et al. | |
| 6,409,264 | B1 | 6/2002 | Palmer et al. | 297/218.3 |
| 6,485,099 | B2 | 11/2002 | Illulian | |
| 6,736,453 | B2 | 5/2004 | Chambers et al. | 297/228.1 |
| 6,796,609 | B2 | 9/2004 | Illulian | 297/218.1 |
| 6,827,398 | B2 | 12/2004 | Nazginov | 297/228 |
| 2004/0155499 | A1 | 8/2004 | Chambers et al. | 297/228.1 |
| 2005/0173953 | A1 | 8/2005 | Riley | 297/228.1 |
| 2006/0012228 | A1 | 1/2006 | Bardouche | |
| 2006/0071520 | A1 | 4/2006 | Miller | |

FOREIGN PATENT DOCUMENTS

| | | |
|---|---|---|
| FR | 2 562 405 | 10/1985 |
| FR | 2 608 403 | 6/1988 |

* cited by examiner

*Primary Examiner*—Anthony D. Barfield
(74) *Attorney, Agent, or Firm*—Fitzpatrick, Cella, Harper & Scinto

(57) ABSTRACT

A slip covered sofa having removable seat cushions which are separately slip covered by a single bag-like cover into which the seat cushions are inserted and which has excess material extending beyond the cushions, the excess material being and folded under the cushions at each end to hold the material on the upper surface of the cushions taut when the cushions are in place on the sofa.

24 Claims, 3 Drawing Sheets

SOFA SLIP COVER AND COVERED SOFA

BACKGROUND OF THE INVENTION

1. Field of the Invention

This invention relates to the covering of upholstered sofas and more particularly it concerns novel coverings for upholstered sofas and chairs as well as upholstered sofas and chairs as so covered.

2. Description of the Related Art

United States Patent Publication US 2004/0095002 shows an adjustable slip cover for upholstered furniture such as chairs or sofas. The sofa or chair base is covered separately from the seat cushions, which themselves are individually covered. Elastic straps and clips are provided on the sofa or chair base cover to hold the material of the cover taut. Extra material in the sofa or chair base cover is also tucked under the cushions.

U.S. Pat. No. 2,367,450 also shows adjustable slip covers for upholstered chairs wherein the chair base cover is separate from the cushion cover. Excess material of the base cover is tucked beneath adjacent portions of the slip cover. The cushion cover is bag shaped and open along the rear edge for insertion of the cushion. The cushion cover is pulled tight and held by strings.

U.S. Pat. No. 2,921,625 show an adjustable slip cover for chairs and sofas. Here also the cover for the chair or sofa base is separate from the cover for the seat cushion The seat cushion cover extends over the top, front and sides of the cushion and appears to be held in place by an elasticized edging.

U.S. Pat. No. 2,884,993 relates to adjustable slip covers for chairs and sofas; and separate covers are provided for the sofa or chair base and for the seat cushion. The cushion covers comprise panels which form a pocket into which the cushions are inserted.

A particular problem involved in providing slipcovers to accommodate upholstered furniture of different sizes and configurations results from the fact that the seat cushions of such furniture are made with widely different shapes, sizes and thicknesses. Prior attempts to handle this problem have involved providing cushion covers that are pulled tight by a drawstring or an elastic band. However, these lack versatility, and they are not suited for use with multiple cushions such as in sofas. Also there is no assurance that the cushion covers will remain taut after someone has sat on the furniture

SUMMARY OF THE INVENTION

In one aspect of the invention there is provided an upholstered chair or sofa having a base on which are mounted, a horizontal seat cushion support, a back, and arms at each end of the cushion support. At least one removable seat cushion rests on the cushion support between the arms. A seat cushion slip cover covers the seat cushion or cushions. The seat cushion slip cover is pulled tight at the ends of the cushion or cushions which abut the arms. This conforms the cover to the shape of the cushion or cushions. The excess cover material which extends beyond the cushion or cushions at the arms is folded under them, whereby the weight of the cushion or cushions holds the cover taut along their upper side.

In another aspect, the invention involves a novel slip covered seat cushion for an upholstered chair or sofa. This novel covered seat cushion comprises an elongated bag-like cover; and at least one seat cushion contained within the cover. The cover itself has excess material extending beyond opposite ends of the seat cushion with the excess material being foldable under the seat cushion.

In a further aspect, the invention comprises a novel slip cover for covering the removable seat cushions of upholstered sofas or chairs. This novel slip cover comprises an elongated bag-like cover for containing the seat cushion or cushions, with substantial excess cover material extending beyond the ends of the cushion or cushions. This excess material at the ends of the slip cover can be folded under the cushion or cushions so that their weight will hold the slip cover tight along their upper surface.

DETAILED DESCRIPTION OF THE PREFERRED EMBODIMENTS

Figure 1:
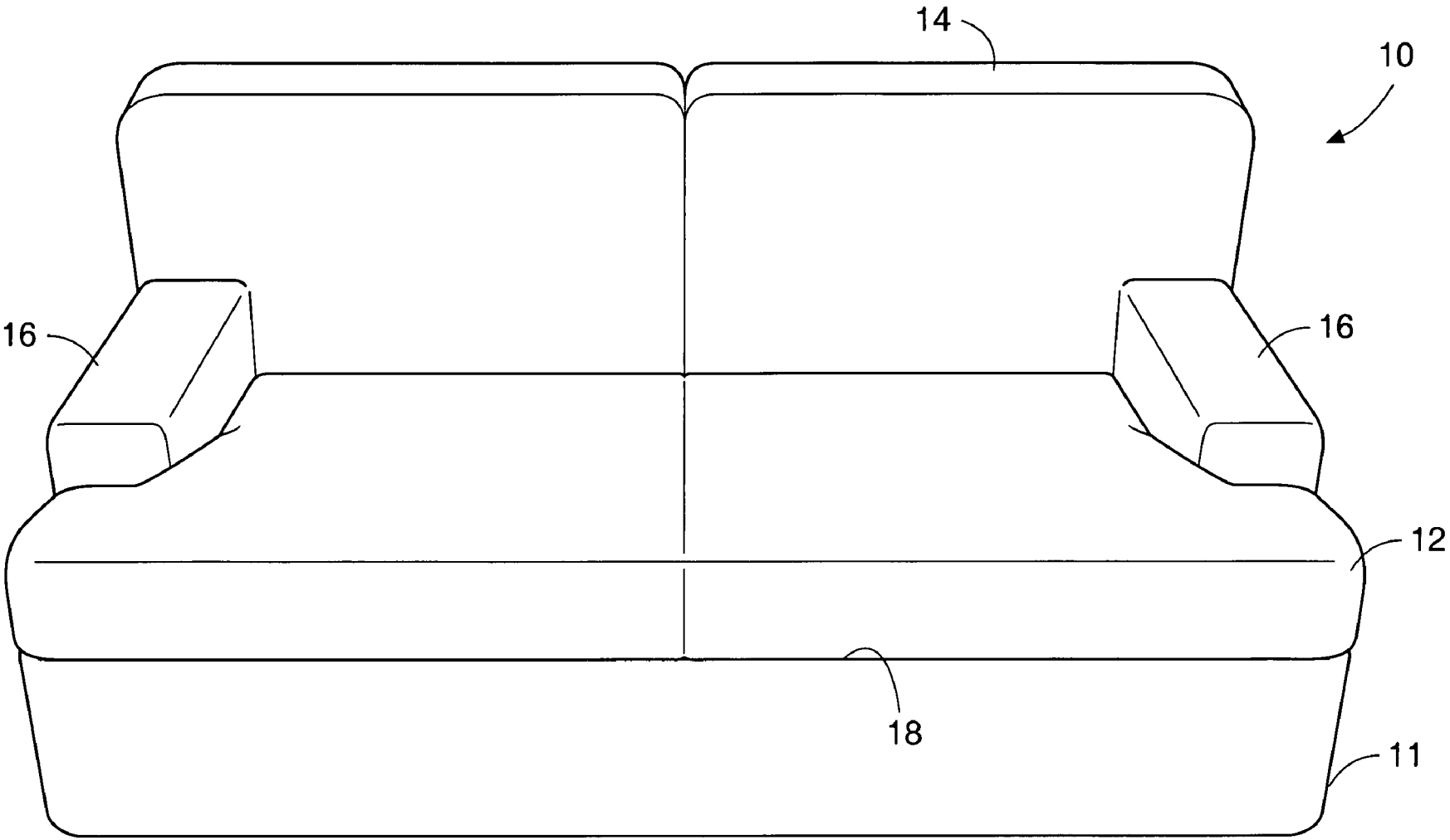
FIG. 1 is a frontal view of a slip covered sofa according to the invention.

In the embodiment of FIG. 1, a sofa 10 comprises a base section 11 and a separately slip covered cushion section 12 which contains one or more seat cushions. The base section 11 has a bottom portion 14 which supports a back 14, a pair of arms 16 at opposite ends of the sofa, and a horizontal cushion support surface 18 between the arms. The cushion section 12 rests on this support surface. The cushion section 12 is removable from the base section 10; and a cushion slip cover 12*a* covers the cushion section. A separate base section slip cover may be provided for the base section 11.

Figure 2:
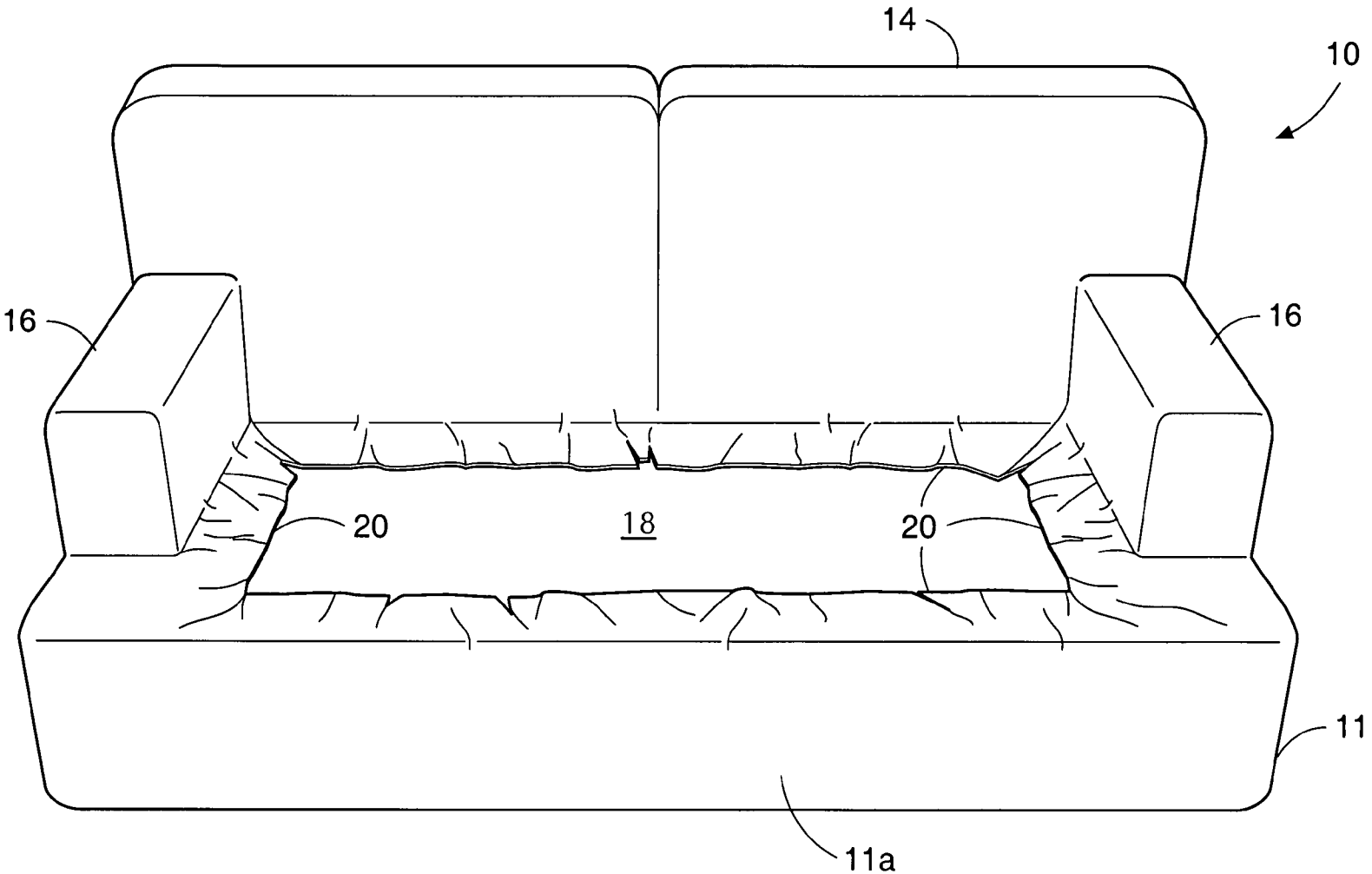
FIG. 2 is a frontal view similar to FIG. 1 but showing the sofa with the covered seat cushion removed.

FIG. 2 shows the base section 11 with the cushion section removed. The base section is shown to have a slip cover 11*a* which is larger than the base section itself; and the excess material of the cover is folded over on the support surface 18 as indicated by the reference character 20.

Figure 3:
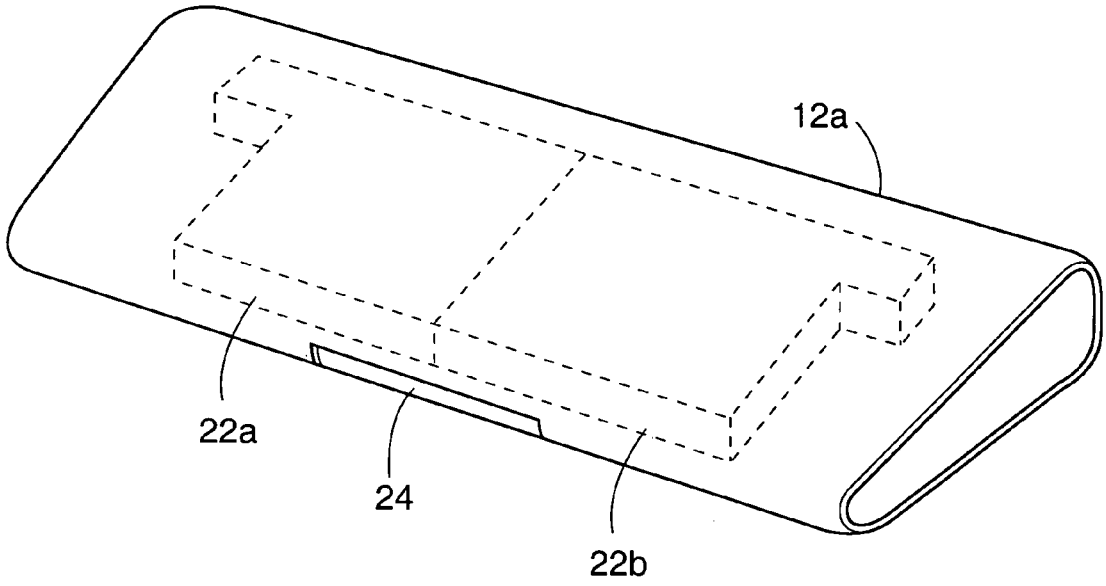
FIG. 3 is a perspective view showing a cushion seat cover according to the invention.

FIG. 3 shows the cushion slip cover 12*a* in perspective and containing two T-shaped seat cushions 22*a* and 22*b* (shown in dashed outline). A cushion insertion opening 24 is provided in the back of the cover 12*a*. This opening can be closed by a zipper, by Velcro® fasteners or by any suitable and well known closure means. It is also possible to provide the insertion opening at one end of the cushion cover 12*a*. Although the ends of the cushion slip cover are shown as being open, they may be sewn closed It will be seen that the ends of the cushion cover 12*a* extend substantially beyond the ends and back of the cushion 22*a* and 22*b*. This allows the cover to accommodate cushions of different widths and depths. The excess material of the cushion slip cover that extends beyond the ends and back of the cushions is pulled tight and folded around the cushions so that the cover material takes on the shape of the cushions (in the present embodiment, a T-shape). The excess material is then pulled under the cushions so that when the cushions are placed on the cushion support 18 of the base 10 (FIG. 1), their weight will hold the material of the cushion cover taut and maintain a smooth upper surface of the cover. In addition, the friction of the arms 16 and the weight of the persons occupying the sofa will add to the holding effect on the cushion slip cover 12*a*.

Figure 4:
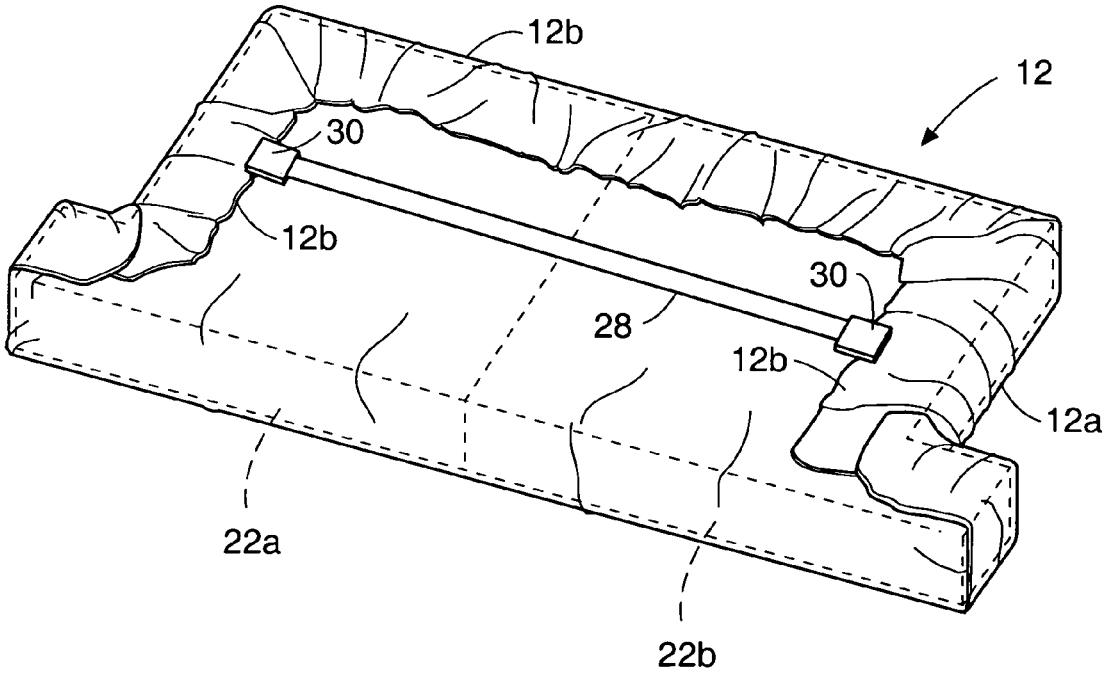
FIG. 4 is a perspective view of a slip covered seat cushion with portions of the slip cover folded over for installation of the seat cushion on a sofa.

FIG. 4 shows the covered seat cushions 22*a* and 22*b* inverted so that the folded over excess material of the cushion cover 12*a* can be seen at 12*b*. The excess material may not only be at the ends of the cover 12*a*; but additional excess material may be provided along its rear edge so as to accommodate seat cushions of different depths.

There may also be provided one or more elastic bands 28 which are attached to the excess cover material 12*b* by means of clips 30 to assist in holding the cover taut. The clips may be any well known clips such as suspender type clips for example.

In installing the seat cushion cover 12*a*, the cushion or cushions are inserted in the cover via the opening 24. The opening is then closed. The cushion or cushions are then arranged to be substantially centered between the ends of the cover 12*a*. Because the cushions can be moved with respect to the ends of the cover 12*a*, it will be possible to have any pattern on the cushion cover 12*a* aligned with a corresponding pattern on the base cover 10*a* The cover 12*a* is then pulled tight at its ends and back; and the excess material of the cover is folded under the cushions. The covered cushions are then positioned on the cushion support as shown in FIG. 1.

The cushion cover of this invention can be made of any slip cover material and may be woven or knit fabric. As an example, the cushions 22*a* and 22*b* would have a depth, from the front elongated edge to the rear of 26 inches and would accommodate a cushion thickness of 6 inches. The length of the cushion cover would depend on the distance from one end of the cushion to the other while allowing sufficient excess material to be folded under the cushions. These dimensions are not critical and a wide range of dimensions may be employed for the cushion slip cover, provided that the cover is large enough to accommodate a wide range of cushion sizes while still leaving sufficient excess material of the cover to be folded under the cushions.

The cushion cover 12*a* may be made to accommodate seat cushions of upholstered chairs as well as sofas. In addition elastic bands, Velcro® fasteners, etc. may be used to hold the excess material under the cushions.

The cushions with the cushion cover may be turned over in the event that the upper surface of the cover becomes worn or stained. In this case the excess material at the ends and back of the cover 12*a* is folded in the reverse direction so that it remains between the cushions and the cushion support.

While this invention has been described in conjunction with T-shaped cushions, it is equally applicable with rectangular cushions or cushions of other shapes. Pulling the material of the cover and then folding it under the ends of the cushions will cause it to conform to whatever the shape of the cushion ends may be.

The invention claimed is:

1. A slip covered sofa comprising:

an upholstered base section integrally comprising a bottom portion which provides a horizontal seat cushion support, a back and arms at each end of said seat cushion support and back;

a plurality of removable upholstered seat cushions on the seat cushion support;

a base section cover covering the bottom portion, the horizontal seat support, the back and the arms of the upholstered base section, the base section cover having a length substantially greater than a width of the base section cover; and a separate single seat cushion cover covering all of the plurality of removable upholstered seat cushions, the seat cushion cover having a length extending at least an entire distance between the arms and being substantially greater than a width of the seat cushion cover, wherein the single seat cushion cover is positioned on the portion of the base section cover covering the horizontal seat support, the seat cushion cover being pulled taut, with any excess material of the seat cushion cover being held under the plurality of removable seat cushions.

2. A slip covered sofa according to claim 1, wherein said seat cushion cover is provided with a closeable opening to permit insertion of the plurality of removable upholstered seat cushions.

3. A slip covered sofa according to claim 1, wherein at least one of the plurality of removable upholstered seat cushions has a T-shaped configuration at its ends.

4. A slip covered sofa according to claim 1, wherein said base section cover is larger than said base section and wherein excess material of said base section cover is folded over onto said seat cushion support.

5. The slip cover assembly according to claim 1, wherein the sofa has two removable upholstered seat cushions.

6. The slip cover assembly according to claim 1, wherein the sofa has three removable upholstered seat cushions.

7. A slip cover assembly configured to cover various sizes of upholstered sofas which have a bottom portion which provides a horizontal seat cushion support, a back and arms at each end of the seat cushion support, and a plurality of removable upholstered seat cushions in contact with the horizontal seat cushion support, said slip cover assembly comprising:

a sofa base section cover for covering the bottom portion, the horizontal seat cushion support, the back and arms at each end of the seat cushion support of the upholstered sofa base section, the base section cover having a length substantially greater than a width of the base section cover; and a separate sofa seat cushion cover for covering all of the plurality of removable upholstered seat cushions, the seat cushion cover having a length extending at least an entire distance between the arms and being substantially greater than a width of the seat cushion cover, at least one of said sofa base section cover and said sofa seat cushion cover having excess material which can be stowed at a position between said base section cover and said seat cushion cover when said seat cushion cover is positioned on the portion of said sofa base section cover covering the horizontal seat cushion support of the base section of the upholstered sofa.

8. A slip cover assembly according to claim 7, wherein an opening is provided in the separate sofa seat cushion cover to permit insertion of the plurality of removable upholstered seat cushions.

9. A slip cover assembly for covering various types of upholstered sofas, each having an upholstered base section integrally comprising a bottom portion which provides a horizontal seat cushion support, a back and arms at each end of the seat cushion support, the various types of upholstered sofas each also having a plurality of removable upholstered seat cushions in contact with the horizontal seat cushion support, said slip cover assembly comprising:

a base section cover for covering the bottom portion, horizontal seat cushion support, back and arms of the upholstered sofa base section, the base section cover having a length substantially greater than a width of the base section cover; and a separate seat cushion cover in the shape of an elongated bag for covering all of the plurality of removable upholstered seat cushions, the seat cushion cover having a length extending at least an entire distance between the arms and being substantially greater than a width of the seat cushion cover.

10. The slip cover assembly according to claim 9, wherein at least one of said base section cover and said seat cushion cover comprises excess material which is stowable at a position between the upholstered sofa base section and the plurality of removable upholstered seat cushions.

11. The slip cover assembly according to claim 10, wherein said base section cover comprises the excess material.

12. The slip cover assembly according to claim 10, wherein said seat cushion cover comprises the excess material.

13. The slip cover assembly according to claim 9, wherein at least one of the plurality of removable upholstered seat cushions is T-shaped.

14. The slip cover assembly according to claim 9, wherein the plurality of removable upholstered seat cushions are rectangular in shape.

15. A slip cover assembly for covering various types of upholstered sofas, each having an upholstered base section integrally comprising a bottom portion which provides a horizontal seat cushion support, a back and arms at each end of the seat cushion support, the various types of upholstered sofas each also having a plurality of removable upholstered seat cushions in contact with the horizontal seat cushion support, the slip cover assembly comprising:

a base section cover for covering the bottom portion, horizontal seat cushion support, back and arms of the upholstered sofa base section, the base section cover having a length substantially greater than a width of the base section cover; and a separate seat cushion cover in the shape of an elongated bag for covering the plurality of removable upholstered seat cushions, the seat cushion cover having a length extending at least an entire distance between the arms and being substantially greater than a width of the seat cushion cover, wherein the separate seat cushion cover has an opening into which the plurality of removable upholstered seat cushions are positioned.

16. The slip cover assembly according to claim 15, wherein at least one of said base section cover and said seat cushion cover comprises excess material which is stowable at a position between the upholstered sofa base section and the plurality of removable upholstered seat cushions.

17. The slip cover assembly according to claim 16, wherein said base section cover comprises the excess material.

18. The slip cover assembly according to claim 16, wherein said seat cushion cover comprises the excess material.

19. The slip cover assembly according to claim 15, wherein the opening is closable by closing means.

20. The slip cover assembly according to claim 19, wherein said closing means comprises a zipper.

21. The slip cover assembly according to claim 19, wherein said closing means comprises a hook and loop fastener.

22. The slip cover assembly according to claim 15, wherein the elongated bag is a rectangular-shaped elongated bag.

23. The slip cover assembly according to claim 15, wherein the elongated bag is configured to receive at least one rectangular-shaped removable upholstered sofa seat cushion.

24. The slip cover assembly according to claim 15, wherein the elongated bag is configured to receive at least one T-shaped removable upholstered sofa seat cushion.

* * * * *